US006578486B2

(12) United States Patent
Mattes et al.

(10) Patent No.: US 6,578,486 B2
(45) Date of Patent: Jun. 17, 2003

(54) IGNITER

(75) Inventors: Bernhard Mattes, Sachsenheim (DE); Jochen Seibold, Tuebingen (DE); Reiner Schuetz, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/048,250

(22) PCT Filed: May 16, 2001

(86) PCT No.: PCT/DE01/01844

§ 371 (c)(1),
(2), (4) Date: Jun. 3, 2002

(87) PCT Pub. No.: WO01/90679

PCT Pub. Date: Nov. 29, 2001

(65) Prior Publication Data

US 2002/0178956 A1 Dec. 5, 2002

(30) Foreign Application Priority Data

May 26, 2000 (DE) ..... 100 26 329

(51) Int. Cl.[7] ..... F42B 3/10; F42B 3/12; F42B 3/16; F42C 11/00; F42C 19/12; F42C 21/00; F23Q 7/02

(52) U.S. Cl. ..... 102/202.13; 102/202.5; 102/202.7; 102/202.9; 102/202.14; 102/206

(58) Field of Search ..... 102/202.5, 202.14, 102/530

(56) References Cited

U.S. PATENT DOCUMENTS 4,422,381 A * 12/1983 Barrett ..... 102/202.2
4,831,933 A * 5/1989 Nerheim et al. ..... 102/202.5
5,495,806 A * 3/1996 Willey ..... 102/202.14
6,166,452 A * 12/2000 Adams et al. ..... 307/10.1
6,178,888 B1 * 1/2001 Neyer et al. ..... 102/202.7
6,467,414 B1 * 10/2002 Fisher ..... 102/202.4

FOREIGN PATENT DOCUMENTS

| | | |
|---|---|---|
| DE | 198 06 915 | 9/1999 |
| DE | 198 46 110 | 4/2000 |
| WO | WO 99 02937 | 1/1999 |

* cited by examiner

*Primary Examiner*—Michael J. Carone
*Assistant Examiner*—H. A. Blackner
(74) *Attorney, Agent, or Firm*—Kenyon & Kenyon

(57) ABSTRACT

The firing apparatus for a gas generator of a restraint device in a vehicle has a firing chamber filled with a pyrotechnic material. A semiconductor chip, in which in addition to a firing resistor at least one circuit activating the latter is integrated, is arranged outside the firing chamber in such a way that the thermal energy generated by the firing resistor during a firing operation is transferred to the pyrotechnic material in the firing chamber. To ensure that upon firing, the circuit elements in the firing apparatus remain undestroyed to the greatest possible extent, the semiconductor chip is retained on a circuit board; the circuit board is retained, with the side opposite the semiconductor chip, on a wall of the firing chamber; and an opening is present in the wall of the firing chamber and in the circuit board, so that a passage exists between the firing resistor mounted on the semiconductor chip and the pyrotechnic material in the firing chamber.

9 Claims, 1 Drawing Sheet

IGNITER

FIELD OF THE INVENTION

The present invention relates to a firing apparatus for a gas generator of a restraint device in a vehicle, a firing chamber filled with a pyrotechnic material being present; and a semiconductor chip, in which in addition to a firing resistor at least one circuit activating the latter is integrated, being arranged outside the firing chamber in such a way that during a firing operation, thermal energy generated by the firing resistor is transferred to the pyrotechnic material in the firing chambers.

BACKGROUND INFORMATION

A firing apparatus is known, for example, from German Patent No. 198 06 915 or WO 99/02937. The firing apparatuses described in these two documents aim not only to accommodate therein a pyrotechnic charge and a firing resistor responsible for the firing thereof, but additionally to accommodate circuit elements necessary for activation of the firing resistor as well as circuits for supplying energy to and/or diagnosing the firing apparatus. What is achieved thereby is a very compact, intelligent firing apparatus that can be connected, for example together with several other firing elements arranged at various points in the vehicle, to a common bus line which creates a connection to a central control unit. Each of the firing elements is installed, in known fashion, in a gas generator that, in the event of initiation, inflates an airbag or triggers a belt tightener.

In the firing apparatus described in WO 99/02937, several semiconductor chips are stacked one above another and contacted to one another using flip-chip technology. The semiconductor chip that is located closest to the firing chamber filled with the pyrotechnic material is embodied as a firing resistor which, when current flows through it, generates thermal energy and thus fires the pyrotechnic charge. A concrete arrangement of the semiconductor chip with the firing resistor and the firing chamber such that the thermal energy proceeding from the firing resistor is transferred to the pyrotechnic charge in the firing chamber, is not disclosed by WO 99/02937.

In German Patent No. 198 06 915, a firing resistor is integrated on a semiconductor chip, and a funnel having a pyrotechnic material charged thereinto rests directly on the semiconductor chip, so that the pyrotechnic material in the funnel is directly in contact with the firing resistor.

If the firing apparatus, as already stated, is connected along with other firing apparatuses to a common bus line, a signal transfer over the bus line to other firing apparatuses should still be possible even when a firing apparatus has already been activated. To ensure, in particular in the context of a daisy-chain bus concept, that signal transfer over the bus line—for the initiation of further restraint means or for a multi-stage initiation of restraint means—is possible even after firing of a firing apparatus, the circuit in the activated firing apparatus should not be completely destroyed, but rather should continue to permit transmission of signals onto the bus line. It is therefore an object of the present invention to provide a firing apparatus whose circuit means remain undestroyed to the greatest possible extent upon firing.

SUMMARY OF THE INVENTION

According to the present invention, the semiconductor chip equipped with the firing resistor is retained on a circuit board; the circuit board is retained, with the side opposite the semiconductor chip, on a wall of the firing chamber; and an opening is present in the wall of the firing chamber and in the circuit board, so that a passage exists between the firing resistor mounted on the semiconductor chip and the pyrotechnic material in the firing chamber.

The firing chamber wall and the circuit board between the firing chamber and the semiconductor chip protect the semiconductor chip from the high temperatures and pressures occurring upon firing of the pyrotechnic charge in the firing chamber, so that the semiconductor, on which several circuit elements are integrated, is largely protected from destruction upon firing of the pyrotechnic charge. If a daisy-chain bus system is in use for the actuators of the restraint systems in the vehicle, signal transmission over the bus would be maintained if the electrical circuit of an activated firing apparatus having the features presented above were still at least partially functional, so that further firing apparatuses on the bus line can subsequently also be activated.

The semiconductor chip is preferably contacted to the circuit board using flip-chip technology, and a filler material is introduced between the circuit board and the semiconductor chip. This ensures optimal protection of the semiconductor chip from high temperature and high pressure during a firing operation.

It is advisable if a ridge surrounding the opening in the circuit board is arranged between the semiconductor chip and the circuit board. This ridge is a barrier to the filler material between the semiconductor chip and the circuit board, and furthermore forms a delimitation, with respect to the remaining region of the semiconductor chip equipped with the further circuit elements, of the combustion chamber in which the firing resistor is located. The ridge is preferably made of a solder material.

For the purpose of enhanced helium sealing, the opening in the circuit board can be equipped with a metallization, and a respective ring of solder material can be introduced both between the semiconductor chip and the metallization and between the wall of the firing chamber and the metallization.

It is advisable to solder the circuit board onto the wall of the firing chamber. A solder join is necessary so that helium sealing of the firing chamber is achieved.

The filler material between the circuit board and the semiconductor chip can be a capillary liquid adhesive or an adhesive paste.

To ensure that the firing delay between the firing resistor and the pyrotechnic charge in the firing chamber is as short as possible, it is advisable to introduce into the opening of the firing chamber wall a flammable contact material, having pyrotechnic properties, that is connected to the pyrotechnic material in the firing chamber.

DETAILED DESCRIPTION

Figure 1:
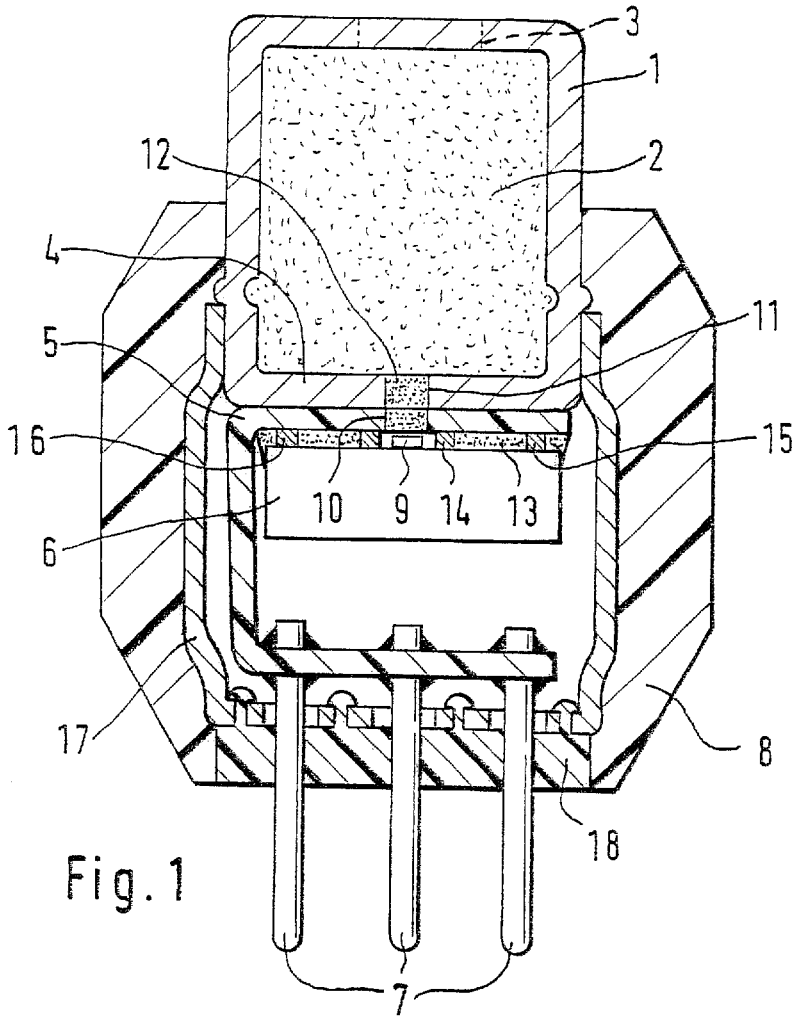
FIG. 1 is a longitudinal section through a firing apparatus.

FIG. 1 constitutes a longitudinal section through a firing apparatus for a gas generator of a restraint device (e.g. airbag, belt tightener, etc.) in a vehicle.

A firing chamber 1, which is filled with a pyrotechnic material 2, is located in the upper part of the firing apparatus.

When the pyrotechnic material is fired, a firing flame emerges through a defined break point 3 in a wall of firing chamber 1, and ignites the gas-generating material present in a gas generator (not depicted in the drawings). The resulting gas penetrates, for example, into an attached airbag and inflates it.

A circuit board 5, preferably a flexible circuit board, is soldered onto that wall 4 of filing chamber 1 which faces into the interior of the firing apparatus. On the side opposite firing chamber 1, a semiconductor chip 6 is contacted to the circuit board 5 using flip-chip technology. As is usual in the known flip-chip technique, contact pads are provided on circuit board 5 and on the semiconductor chip, and are connected to one another by soldering. Conductor paths that lead to terminal pins 7 in the lower region of the firing apparatus are located on circuit board 5. By way of these terminal pins 7 and the conductor paths on circuit board 5, an electrical connection is made between, for example, a bus line and terminal contacts of semiconductor chip 6. Part of firing chamber 1, and circuit board 5, semiconductor chip 6, and terminal pins 7, are together encased by a plastic body 8. Plastic body 8 is injection-molded around a metal sleeve 17 that in the upper region surrounds firing chamber 1 and in the lower region is equipped with a plastic retaining part 18 for terminal pins 7 that emerge from metal sleeve 17. Metal sleeve 17 also forms a space for semiconductor chip 6 and circuit board 5.

A firing resistor 9 made of semiconductor material is applied, in the form of thin-film elements, on the upper side of semiconductor chip 6 facing toward circuit board 5. Firing resistor 9 is made, for example, of materials such as titanium, palladium, zirconium, and copper oxide. An opening 10, 11 is provided directly above firing resistor 9 in circuit board 5 and in wall 4 of firing chamber 1, respectively. Through these two superimposed openings 10 and 11, the thermal energy generated by firing resistor 9 is transferred into firing chamber 1 to pyrotechnic material 2 present therein. In order to make the time between the heating of firing resistor 9 and the firing of the pyrotechnic material in firing chamber 1 as short as possible (50 to 100 microseconds), it is advisable to introduce into openings 10 and 11 in circuit board 5 and in firing chamber wall 4 a flammable contact material 12 that is directly connected to pyrotechnic material 2 in firing chamber 1 and to firing resistor 9 on semiconductor chip 6.

In order to protect semiconductor chip 6 from high temperature and high pressure during a firing event, it is advisable to insert a filler material 13 between semiconductor chip 6 and circuit board 5. This filler material can be a capillary liquid adhesive or a pasty adhesive. To prevent the filler material from penetrating into the region of firing resistor 9, a ridge 14 that surrounds opening 10 in circuit board 5 and the region of firing resistor 9 on semiconductor chip 6 is arranged between semiconductor chip 6 and circuit board 5. This ridge 14 is made of solder material. Ridge 14 also has the function of delimiting the combustion chamber, below which firing resistor 9 is located, from the other regions of semiconductor chip 6 in order to protect the circuit elements integrated therein. Relevant circuit elements include, for example, activation circuits and/or diagnostic circuits for firing resistor 9, an energy reservoir for supplying power to the circuit elements and the firing resistor, a bus interface, components for protection against electrostatic interference, etc.

Firing resistor 9 is advantageously located on the edge of semiconductor chip 6, i.e. at a distance from the other circuit components, so that the latter are damaged at little as possible upon firing.

Ridge 14, made of solder, can be applied either onto circuit board 5 or onto semiconductor chip 6. In this process, simultaneously with ridge 14 it is possible also to create one or more further solder bumps 15, 16 that provide electrical contacting between circuit board 5 and semiconductor chip 6.

Figure 2:
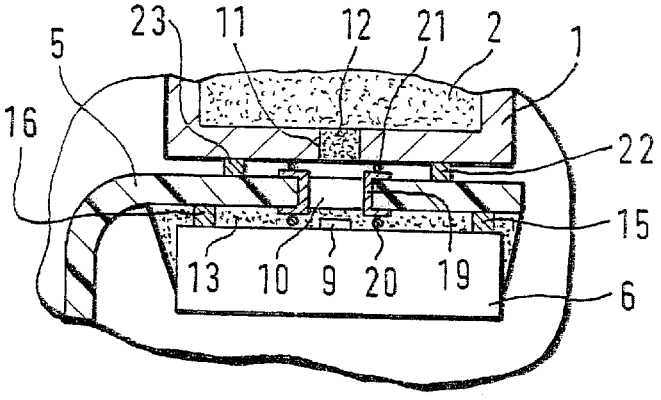
FIG. 2 shows a portion of the firing apparatus with a connection between a semiconductor chip, a circuit board, and a firing chamber.

FIG. 2 shows a portion of the firing apparatus with a configuration for the connection between semiconductor chip 6, circuit board 5, and firing chamber 1 that is different from FIG. 1.

Firing resistor 9, pyrotechnic material 2, and flammable contact material 12, must be sealed in moisture-tight fashion so that their electrical and chemical properties do not change. Moisture tightness is best tested using the helium leak test detection method. A helium-tight seal of the firing chamber, in accordance with the exemplary embodiment of FIG. 2, be created by the fact that opening 10 in circuit board 5 is equipped on the inner side with a metallization (e.g. copper, zinc) 19 which extends out beyond the edge of opening 10 onto the upper and lower sides of circuit board 5. A first solder ring 20 connects metallization 19 to semiconductor chip 6, and a second solder ring 21 connects metallization 19 to wall 4 of firing chamber 1. Further solder points 22, 23 can also be provided to connect circuit board 5 to firing chamber wall 4.

What is claimed is:

1. A firing apparatus for a gas generator of a restraint device in a vehicle, comprising:

a firing chamber filled with a pyrotechnic material, the firing chamber having a wall;

a circuit board; and a semiconductor chip including a firing resistor and at least one activating circuit, the semiconductor chip being situated outside the firing chamber such that, during a firing operation, thermal energy generated by the firing resistor is transferred to the pyrotechnic material in the firing chamber, the semiconductor chip being situated on the circuit board, wherein the circuit board is situated, with a side opposite the semiconductor chip, on the wall of the firing chamber, and wherein the wall of the firing chamber and the circuit board have an opening defining a passage between the firing resistor mounted on the semiconductor chip and the pyrotechnic material in the firing chamber.

2. The firing apparatus according to claim 1, wherein the semiconductor chip is contacted to the circuit board using flip-chip technology, and further comprising filler material situated between the circuit board and the semiconductor chip.

3. The firing apparatus according to claim 1, further comprising a ridge surrounding the opening in the circuit board and being situated between the semiconductor chip and the circuit board.

4. The firing apparatus according to claim 3, wherein the ridge is a ring of solder material applied onto one of the semiconductor chip and the circuit board.

5. The firing apparatus according to claim 1, wherein the opening in the circuit board is equipped with a metallization, and further comprising a respective ring of a solder material situated both between the semiconductor chip and the matallization and between the wall of the firing chamber and the metallization.

6. The firing apparatus according to claim 1, wherein the circuit board is soldered onto the wall of the firing chamber.

7. The firing apparatus according to claim 2, wherein the filler material is a capillary liquid adhesive.

8. The firing apparatus according to claim 2, wherein the filler material is an adhesive paste.

9. The firing apparatus according to claim 1, further comprising a flammable contact material connected to the pyrotechnic material in the firing chamber and situated in the opening of the wall of the firing chamber.

* * * * *